US005490569A

United States Patent [19]

Brotherton et al.

[11] Patent Number: 5,490,569

[45] Date of Patent: Feb. 13, 1996

[54] DIRECTIONAL BORING HEAD WITH DEFLECTION SHOE AND METHOD OF BORING

[75] Inventors: Jimmy L. Brotherton, Grants Pass, Oreg.; Roger R. Layne; Cody L. Sewell, both of Perry, Okla.

[73] Assignee: The Charles Machine Works, Inc., Perry, Okla.

[21] Appl. No.: 215,649

[22] Filed: Mar. 22, 1994

[51] Int. Cl.[6] ..... E21B 7/06

[52] U.S. Cl. ..... 175/61; 175/45; 175/73

[58] Field of Search ..... 175/45, 61, 62, 175/73, 74, 76, 256

[56] References Cited

U.S. PATENT DOCUMENTS

| | | | |
|---|---|---|---|
| Re. 33,660 | 8/1991 | Jelsma | 175/107 |
| Re. 33,793 | 1/1992 | Cherrington et al. | 175/61 |
| 2,819,039 | 1/1958 | Lindsay et al. | 175/73 |
| 3,997,008 | 12/1976 | Kellner | 175/45 |
| 4,040,495 | 8/1977 | Kellner et al. | 175/73 |
| 4,501,336 | 2/1985 | Kemp et al. | 175/61 |
| 4,560,014 | 12/1985 | Geczy | 175/107 |
| 4,597,454 | 7/1986 | Schoeffler | 175/61 |
| 4,667,751 | 5/1987 | Geczy et al. | 175/71 |
| 4,679,673 | 7/1987 | Yamaoka et al. | 192/21 |
| 4,732,223 | 3/1988 | Schoeffler et al. | 175/73 |
| 4,784,230 | 11/1988 | Cherrington et al. | 175/61 |
| 4,811,798 | 3/1989 | Falgout, Sr. et al. | 175/73 |
| 4,880,067 | 11/1989 | Jelsma | 175/107 |

FOREIGN PATENT DOCUMENTS

| | | | |
|---|---|---|---|
| 260192 | 10/1989 | Japan | 175/61 |

*Primary Examiner*—David J. Bagnell

*Attorney, Agent, or Firm*—Richards, Medlock & Andrews

[57] ABSTRACT

A boring apparatus (10) is disclosed which includes a casing (16) mounting a drill bit (42) and a deflection shoe (22). The cutting circle of the drill bit is offset from the centerline axis (18) of the casing (16). At least a portion of the deflection shoe (22) lies outside the cutting circle of the drill bit so that the deflection shoe causes the boring apparatus to deflect as the borehole is drilled. Rotation of the casing 16 a predetermined distance will cause the boring apparatus to change the direction of deflection. A continuous rotation of the casing will permit the boring apparatus to bore straight ahead. The drill stem (32, 68, 74) rotating the drill bit can be mounted concentric with the centerline axis of the casing and offset therefrom, at an angle relative to the centerline axis and can be sufficiently flexible to be curved to accommodate the signal beacon housing.

31 Claims, 6 Drawing Sheets

DIRECTIONAL BORING HEAD WITH DEFLECTION SHOE AND METHOD OF BORING

TECHNICAL FIELD OF THE INVENTION

This invention relates to a device for horizontal boring, and in particular for boring through rock with directional control.

BACKGROUND OF THE INVENTION

Trenchless boring has become a preferred technique for drilling boreholes for installation of utility, telephone, gas, and other lines underground. In early devices, there was no practical way to steer the boring device as it bore underground. However, devices have been developed which permit steering to correct the course of the borehole and provide better control of the exit point of the borehole. However, there is an ongoing need for improved boring devices which have better and simpler steering control functions.

SUMMARY OF THE INVENTION

In accordance with one aspect of the present invention, an apparatus is provided for boring a hole with directional control. The apparatus includes a body having an elongate axis and a front end. A drill bit is mounted at the front end of the body for rotary motion about a drill bit axis. A deflection shoe is mounted on a first side of the body. Rotating structure is used to rotate the drill bit continuously to bore the hole. Deflection control structure is used to selectively rotate the body independent of the drill bit to position the deflection shoe to deflect the apparatus within the bore to provide steering of the apparatus as the bore is formed.

In accordance with another aspect of the present invention, the drill bit axis can be parallel the elongate axis of the body and offset therefrom. Alternatively, the drill bit axis can be at an angle relative to the elongate axis of the body and a drill bit rotating shaft either mounted for rotation within the body at an angle or flexible.

In accordance with another aspect of the present invention, the drill bit can be a three-cone rotary bit, a drag bit or a multiple wing bit. A signal beacon can be mounted in the body, either on the first side of the body with the deflection shoe to assist the deflection shoe in deflecting the apparatus or opposite the deflection shoe.

In accordance with another aspect of the present invention, the deflection control structure is mounted within the body and includes a first dog fixed to the drill string and a second dog mounted in the body. The drill string is movable along its axis from a first position with the dogs disengaged to a second position engaging the dogs to rotate the body with the drill string to position the deflection shoe to deflect the apparatus within the bore. The body may also be rotated independent of the drill bit when the rotating structure (casing, conduit or wash-over pipe) is attached to the body and used as the rotator.

In accordance with another aspect of the present invention, the deflection control structure is mounted externally of the body and includes a first dog fixed to the drill bit and a second dog mounted on the body and forming the deflection shoe. The drill string being movable along its axis from a first position with the dogs disengaged to a second position engaging the dogs to rotate the body with the drill string to position the deflection shoe to deflect the apparatus within the bore. The body may also be rotated independent of the drill bit when the rotating structure (casing, conduit or wash-over pipe) is attached to the body and used as the rotator.

BRIEF DESCRIPTION OF THE DRAWINGS

For a more complete understanding of the present invention and for further advantages thereof, reference is now made to the following description of the preferred embodiment, taken in conjunction with the accompanying drawings, in which.

DETAILED DESCRIPTION

Figure 1:
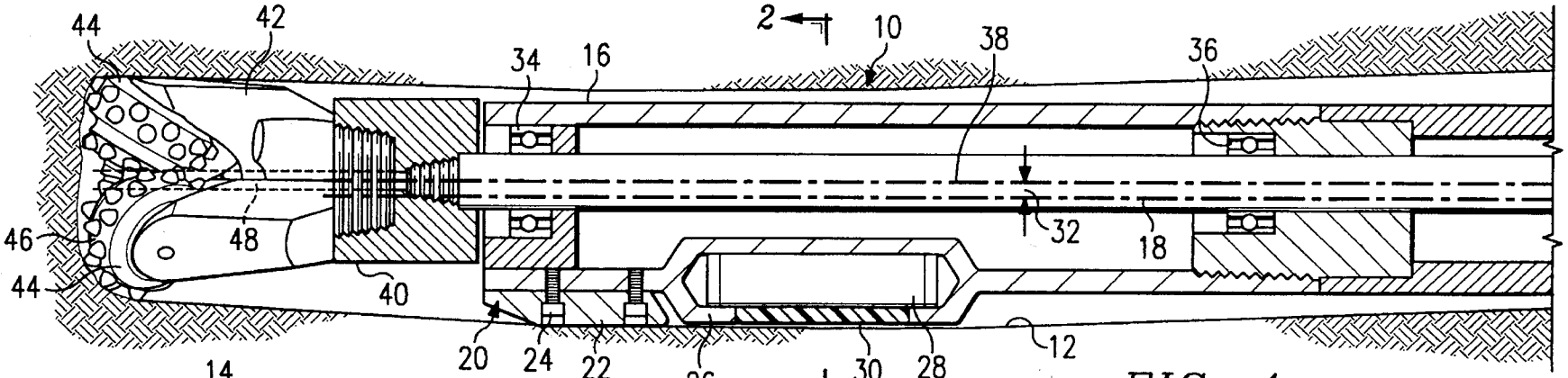
FIG. 1 is a side view in cross-section of a boring apparatus forming a first embodiment of the present invention.
Figure 2:
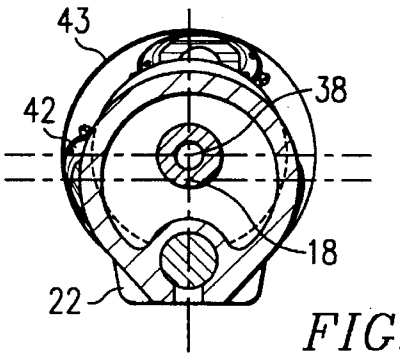
FIG. 2 is a cross-sectional view of the boring apparatus of FIG. 1 taken along line 2—2 in FIG. 1.

With reference now to FIGS. 1 and 2, a first embodiment of the present invention is illustrated and formed by boring apparatus 10. The boring apparatus 10 is used to bore a borehole 12 through ground 14 with directional control of the borehole.

The apparatus includes a casing 16 having a centerline axis 18. The casing 16 is at the head of a series of casing segments (not shown) which extend back to the entry point for the borehole.

Mounted near the front end 20 of the casing 16 is a removable deflection shoe 22. The deflection shoe is bolted to the front end 20 of the casing 16 by a series of threaded bolts 24 which permit replacement of the deflection shoe 22, when worn, or the installation of a deflection shoe of different configuration for a particular boring operation. Immediately behind the position of the deflection shoe 22 is a housing 26 formed to contain an electronic beacon 28 or other tracking technologies. The housing includes an electrically transparent cover 30 which permits the signal generated by beacon 28 to be radiated outwardly from the casing for detection at the surface.

A drill stem 32 is mounted for rotation within the casing 16 by a forward bearing 34 and rearward bearing 36. The bearing supports the drill stem so that the drill stem axis of rotation 38 is parallel to, but spaced from the axis 18 of the casing. Preferably, the drill stem axis 38 is spaced from the centerline axis 18 on the side opposite of the deflection shoe 22.

A drill bit base 40 is mounted on the threaded forward end of the drill stem 32 which extends outwardly from the first end of the casing. A drill bit 42 is threadedly received in the base 40 such that it forms the most forward extending portion of the boring apparatus. The drill bit 42 has three rotary cutting cones 44 with cutting elements 46 thereon or other styles of bits such as a drag bit and a multiple wing bit.

In boring, the rearward end of the drill stem 32 is connected to drill pipe or rod extending to the surface. At the surface, a rotary mechanism rotates the drill stem and thereby the drill bit 42. As the boring apparatus 10 is pushed forward, the drill bit 42 will cut into the exposed face of borehole 12, boring further into the ground. Without rotation of the casing 16 about its centerline axis 18, the presence of the deflection shoe 22, and to a lessor extent, the bulge caused by the casing 16, will cause the apparatus to deflect from a linear path in a direction opposite the position of the deflection shoe. Without casing rotation, this deflection will be relatively constant and the boring apparatus 10 will therefor drill a constant radius arcuate bore between the entry point and exit point. However, the casing can be rotated about its centerline axis 18 to either change the direction of motion of the apparatus or to allow the apparatus to move forward in a straight line. To move forward in a straight line, the casing will preferably be rotated at a constant angular velocity, usually significantly less than the angular velocity of the drill bit 42 cutting the bore. To simply deflect the apparatus in a different direction, the casing need only be rotated a certain number of degrees about the centerline axis 18 to position the deflection shoe 22 opposite the direction in which the apparatus is to be moved. The deflection shoe will thereafter move the apparatus in the desired direction as the apparatus is moved further forward within the bore.

As can best be seen in FIG. 2, the cutting circle 43 of the drill bit 42 is offset from the centerline axis 18 of the casing by the amount of offset predetermined by the mounting of the drill stem 32. At least a portion of the deflection shoe 22 will lie outside the cutting circle 43 of the drill bit, as will generally a portion of the housing 26, to provide the necessary force to deflect the boring apparatus.

If desired, the drill stem 32 can be hollow for flow of pressurized fluid into the base 40 and into a passage 48 within the drill bit 42 to cool, lubricate and wash the cutting cones 44 to enhance the boring operation.

Figure 3:
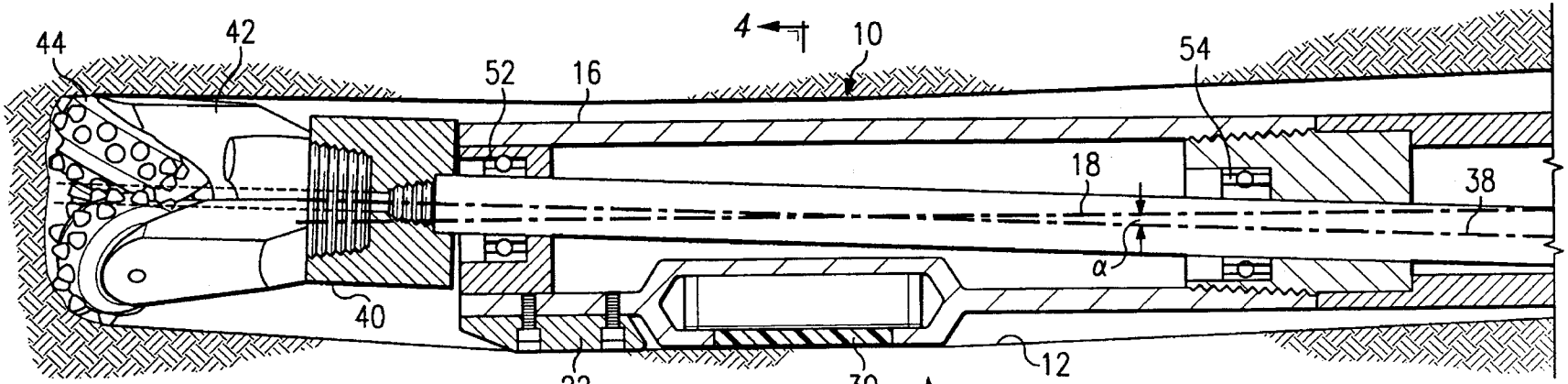
FIG. 3 is a side view in cross-section of a modified boring apparatus.
Figure 4:
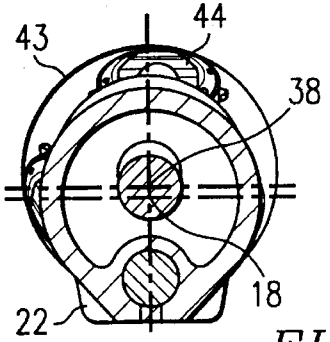
FIG. 4 is a cross-sectional view taken along lines 4—4 in FIG. 3.

With reference now to FIGS. 3 and 4, a boring apparatus 50 forming a first modification of the boring apparatus 10 is illustrated. A number of elements are identical with boring apparatus 10 and are identified with the same reference numeral. However, the boring apparatus 50 includes a forward bearing 52 and a rearward bearing 54 which are positioned within the casing so that the drill stem axis 38 is at an angle $\alpha$ relative to the centerline axis 18 of the casing 16. The angle is such that the cutting circle of the drill bit 42 is again non-concentric with the cross-section of the casing 16 extending beyond the circumference of the casing in the direction opposite of the deflection shoe. As will be understood, the drill pipe or rod connecting to the drill stem 32 has sufficient flexibility so that it will bend enough to stay within the interior volume of the casing back to the surface.

Figure 5:
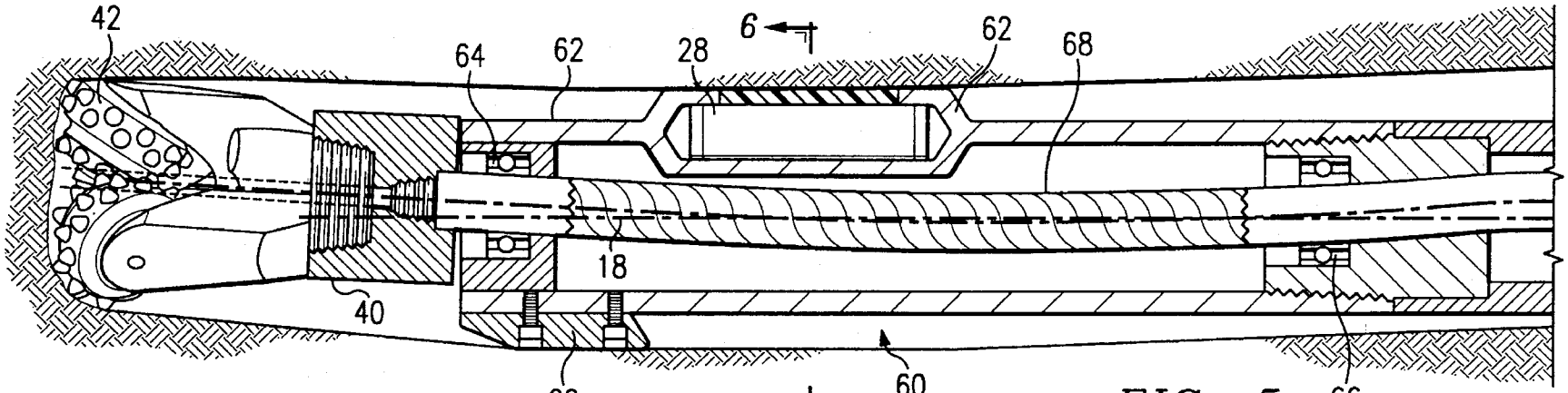
FIG. 5 is a side view in cross-section of a second modified boring apparatus.
Figure 6:
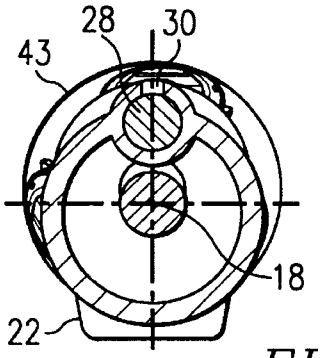
FIG. 6 is a cross-sectional view along line 6—6 in FIG. 5.

With reference to FIGS. 5 and 6, a second modification of the present invention is illustrated as boring apparatus 60. Again, many elements of boring apparatus 60 are identical to boring apparatus 10 and are identified by the same reference numerals.

Boring apparatus 60, however, has a housing 62 for containing the signal beacon 28 on the side opposite of the deflection shoe 22. Furthermore, the forward bearing 64 and rearward bearing 66 support the drill stem 68 at approximately equal, but opposite angles relative to the centerline axis 18 of the casing 16. The drill stem 68 is, itself, a flexible shaft which can deflect somewhat about its elongate direction while carrying torque adequate to rotate the drill bit 42. The position of the bearing 64 and 66 create an arcuate curvature in the drill stem which is designed to provide a clearance between the drill stem and the housing 62.

As the boring apparatus described herein are typically used to create an arcuate borehole that is concave relative to the surface, the beacon in boring apparatus 60 will typically be at the upper part of the apparatus closest to the surface. This permits a somewhat greater signal strength to be received at the surface because the boring apparatus does not interfere with the beacon's signal.

Figure 7:
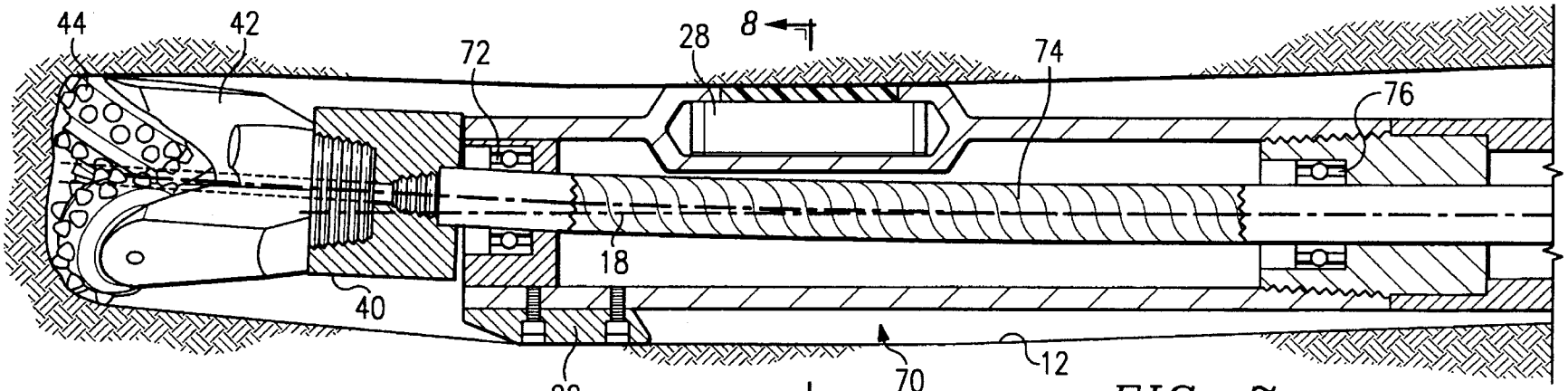
FIG. 7 is a side view in cross-section of a third modified boring apparatus.
Figure 8:
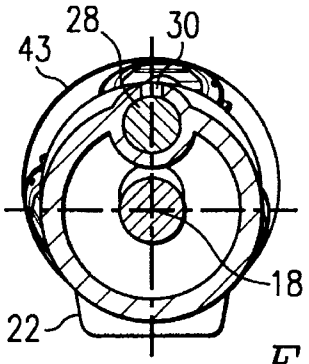
FIG. 8 is a cross-sectional view along line 8—8 of FIG. 7.

With reference now to FIGS. 7 and 8, a third modification of the present invention is illustrated as boring apparatus 70. In apparatus 70, the forward bearing 72 is offset from the centerline axis 18 of the casing 16 and permits the drill stem 74 to rotate about an axis at an angle relate to the centerline axis 18. However, the rearward bearing 76 is positioned concentric with and in alignment with the centerline axis 18. The drill stem 74, as drill stem 68, is flexible in the elongate direction sufficient to accommodate the change in axis of rotation of the drill stem between the forward and rearward bearing.

With reference now to FIGS. 9–12, a direction change mechanism 80 for use in the present invention will be described. The mechanism includes an intermediate casing 82 which is threaded to the casing 16 at one end and to the remainder of the casing extending to the surface at the other end. Rigidly mounted within the intermediate casing 82 is a bearing 84 and a fixed dog 86. A shaft 88 having a square cross-section is received in the bearing 84 for rotation about the centerline axis 18 but is permitted through bearing 84 to move back and forth a limited distance along the centerline axis. The rearward end of the shaft 88 is threaded to a rotating drive shaft 90 which extends, usually with multiple segments, back to the surface where it is attached to a rotating device to rotate the drill bit 42 for boring. A hex shaft 92 is threaded at the forward end of the shaft 88 and also mounts a rotating dog 94. A centering shaft 96 extends forward from the hex shaft 92.

A collar 98 has a hexagonal section 100 which receives the hex shaft 92 and a centering section 102 which receives the centering shaft 96. The drill stem 32, 68 or 74 of any of the boring apparatus can be threaded to the collar 98 as shown.

The configuration of the collar 98 and hex shaft 92 permit a continuous rotation force to be transmitted between the hex shaft 92 to the collar 98 while the hex shaft 92 moves a limited distance along the centerline axis 18 relative to the collar 98.

Figure 9:
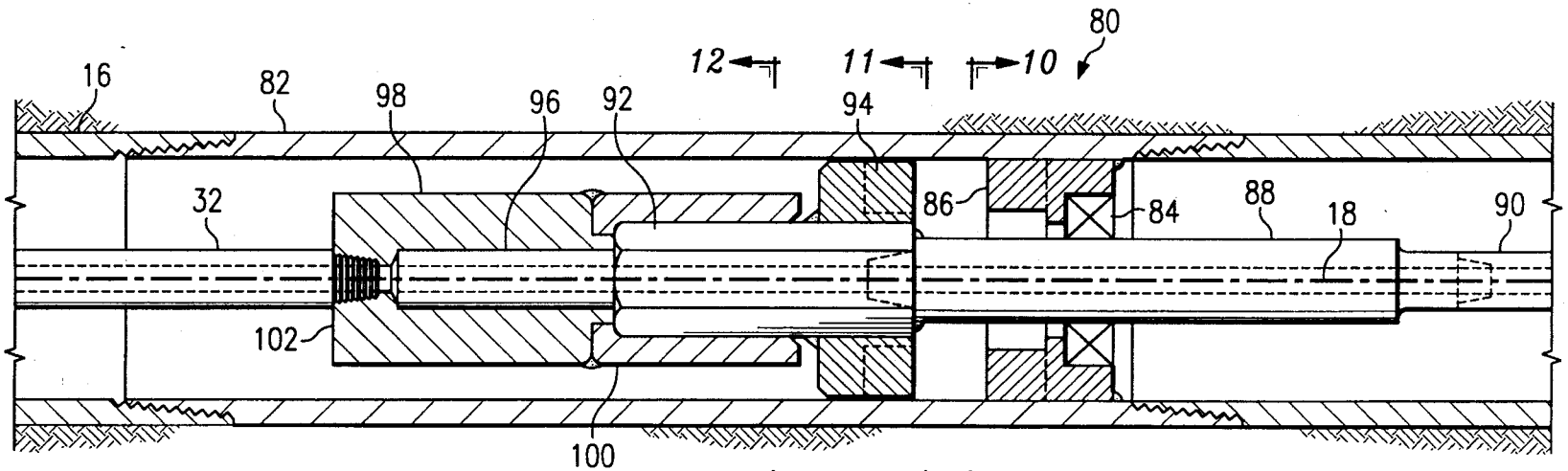
FIG. 9 is a side view in cross-section of an internal direction change mechanism used in the boring apparatus.
Figure 12:
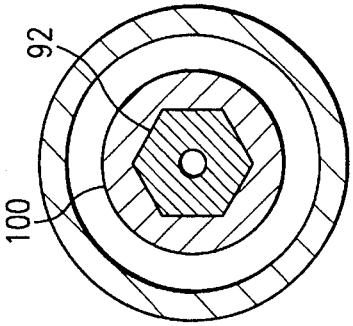
FIG. 12 is a cross-sectional view of the direction change mechanism along line 12—12 in FIG. 9.
Figure 11:
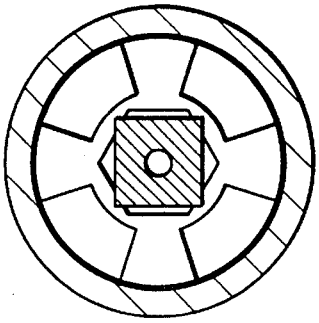
FIG. 11 is a cross-sectional view of the direction change mechanism along line 11—11 in FIG. 9.
Figure 10:
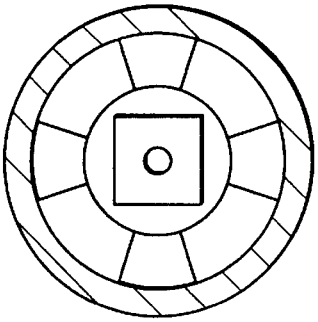
FIG. 10 is a cross-sectional view of the direction change mechanism along line 10—10 in FIG. 9.

In FIG. 9 the hex shaft 92 is shown in the position closest to the drill bit permitted by the components. In this position, the rotating dog 94 is separate from the fixed dog 86. Therefore, rotation of the shaft 88 will be transferred through the direction change mechanism to the drill stem and drill bit to provide boring action without rotation of the casing 16 about the centerline axis 18. However, if the shaft is pulled away from the drill bit, in the direction to the right in FIG. 9, the rotating dog 94 will engage the fixed dog 86. When engaged, rotation of the shaft 88 will not only rotate the drill bit, but also the casing 16. Therefore, when so engaged, the boring apparatus will move forward in a straight line without curvature. However, the engagement can be only for a sufficient a rotation as is required to reposition the deflection shoe at the position opposite the direction the boring apparatus is to be moved and then disengaged to again initiate constant rotation of the drill bit to begin boring in the new direction.

Figure 13:
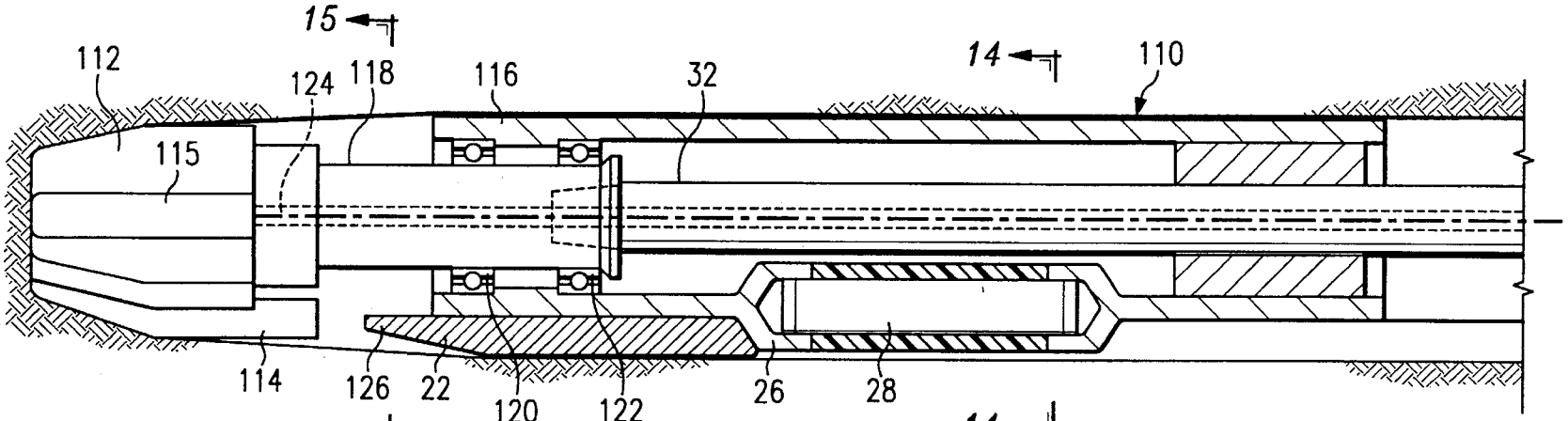
FIG. 13 is a side view in cross-section of an external direction change mechanism used in the boring apparatus.
Figure 15:
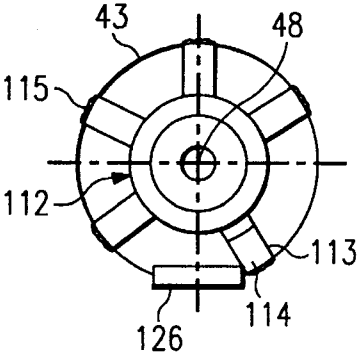
FIG. 15 is a cross-sectional view of the direction change mechanism along a line 15—15 in FIG. 13.
Figure 14:
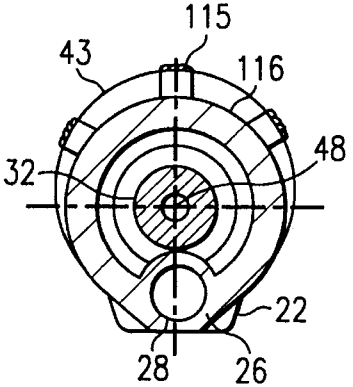
FIG. 14 is a cross-sectional view of the direction change mechanism along a line 14—14 in FIG. 13.

With reference now to FIGS. 13–15, another modification of the present invention is illustrated as boring apparatus 110. A number of the elements of boring apparatus 110 are identical to the previous examples and are identified by the same reference numerals. However, boring apparatus 110 can be seen to use a drill bit 112 which is a multiple blade drag bit or wing bit with individual wings 113 having cutting elements 115 on the exposed end of each wing 113. The cutting elements are capable of cutting rock and can include a carbide coating or diamond coating. Drill bit 112 has an integral first dog 114 extending rearward therefrom external the casing 116 of the boring apparatus. The drill bit 112 is mounted on a slidable segment 118 which is mounted in forward bearing 120 and rearward bearing 122 for rotational motion about axis 124 and limited linear motion along the axis 124 from an extended position, as seen in FIG. 13, to a retracted position. In the retracted position, the first dog 114 interferes with deflection shoe 22, a portion of which forms a second dog 126.

When the boring apparatus 110 is to bore without rotation of the casing 116, the drill stem 32 threaded into the rear end of the segment 118 moves the segment to the extended position, seen in FIG. 13, where the drill bit 112 is free to rotate about the axis 124 without the first dog 114 interfering with or contacting the second dog 126. However, if the casing is to be rotated, the drill stem 32 is moved rearward to move the segment 118 to a position where rotation of the drill bit will cause the first dog 114 to contact the second dog 126. Thereafter, rotation of the drill bit will simultaneously cause rotation of the casing 116 in the particular direction the drill bit motion is established. The direction and degree of motion of the casing 116 can be controlled from the surface by controlling rotation of the drill bit 112 to steer the boring apparatus 110 in the desired direction.

Although the present invention has been described with respect to specific preferred embodiments thereof, various changes and modifications may be suggested to one skilled in the art, and it is intended that the present invention encompass such changes and modifications as fall within the scope of the appended claims.

We claim:

1. An apparatus for boring a hole with a directional control from the surface comprising:

a body having an elongate axis and a front end;

a drill bit mounted at the front end of the body for rotary motion about a drill bit axis, the drill bit axis being constantly noncoincident with the elongate axis of the body at the front end;

a casing rigidly secured to the body and extending to the surface to selectively rotate the body independent of the drill bit to position the deflection Shoe to deflect the apparatus within the bore;

a deflection shoe mounted on a first side of the body; rotating structure to rotate the drill bit continuously to bore the hole, the rotating structure extending to the surface.

2. The apparatus of claim 1 wherein the drill bit axis is parallel the elongate axis of the body.

3. The apparatus of claim 2 wherein the drill bit axis is offset from the elongate axis.

4. The apparatus of claim 1 wherein the drill bit axis is at an angle relative to the elongate axis of the body.

5. The apparatus of claim 4 wherein the apparatus includes a drill bit rotating shaft rotatably mounted within the body.

6. The apparatus of claim 5 wherein the drill bit rotating shaft is flexible.

7. The apparatus of claim 1 wherein the drill bit is a three cone rotary (roller) bit.

8. The apparatus of claim 1 wherein the drill bit is a drag bit for boring various soil and rock formations.

9. An apparatus for boring a hole with a directional control comprising:

a body having an elongate axis and a front end;

a drill bit mounted at the front end of the body for rotary motion about a drill bit axis;

a deflection shoe mounted on a first side of the body;

rotating structure to rotate the drill bit continuously to bore the hole;

deflection control structure to selectively rotate the body independent of the drill bit to position the deflection shoe to deflect the apparatus within the bore;

a drill bit rotating shaft rotatably mounted within the body;

the drill bit rotating shaft being mounted within the body at an angle relative to the elongate axis of the body.

10. An apparatus for boring a hole with a directional control comprising:

a body having an elongate axis and a front end;

a drill bit mounted at the front end of the body for rotary motion about a drill bit axis;

a deflection shoe mounted on a first side of the body;

rotating structure to rotate the drill bit continuously to bore the hole;

deflection control structure to selectively rotate the body independent of the drill bit to position the deflection shoe to deflect the apparatus within the bore;

a signal beacon being mounted in the body.

11. The apparatus of claim 10 wherein the signal beacon is mounted on the first side of the body to assist the deflection shoe.

12. The apparatus of claim 10 wherein the signal beacon is mounted on the side of the body opposite to the first side.

13. An apparatus for boring a hole with a directional control comprising:

a body having an elongate axis and a front end;

a drill bit mounted at the front end of the body for rotary motion about a drill bit axis;

a deflection shoe mounted on a first side of the body;

rotating structure to rotate the drill bit continuously to bore the hole;

deflection control structure to selectively rotate the body independent of the drill bit to position the deflection shoe to deflect the apparatus within the bore;

the deflection control structure being mounted within the body and including a first dog fixed on the body and a second dog mounted on the rotating structure for rotating the drill bit, the rotating structure being movable along its axis from a first position with the dogs disengaged to a second position engaging the dogs to rotate the body to position the deflection shoe to deflect the apparatus within the bore.

14. The apparatus of claim 13 further comprising structure to rotate the body independent of the drill bit.

15. An apparatus for boring a hole with a directional control comprising:

a body having an elongate axis and a front end;

a drill bit mounted at the front end of the body for rotary motion about a drill bit axis;

a deflection shoe mounted on a first side of the body;

rotating structure to rotate the drill bit continuously to bore the hole;

deflection control structure to selectively rotate the body independent of the drill bit to position the deflection shoe to deflect the apparatus within the bore;

the deflection shoe being bolted to the body.

16. An apparatus for boring a hole with a directional control comprising:

a body having an elongate axis and a front end;

a drill bit mounted at the front end of the body for rotary motion about a drill bit axis;

a deflection shoe mounted on a first side of the body;

rotating structure to rotate the drill bit continuously to bore the hole;

deflection control structure to selectively rotate the body independent of the drill bit to position the deflection shoe to deflect the apparatus within the bore;

the deflection control structure being mounted externally of the body and including a first dog fixed to the drill bit and a second dog mounted on the body and forming the deflection shoe, the drill bit being movable along its axis from a first position with the dogs disengaged to a second position engaging the dogs to rotate the body with the drill string to position the deflection shoe to deflect the apparatus within the bore.

17. The apparatus of claim 16 further comprising structure to rotate the body independent of the drill bit.

18. An apparatus for boring a hole with directional control from the surface, comprising:

a casing having an elongate axis and a forward end, the casing mounting a forward bearing therein and a rearward bearing therein proximate the forward end, the casing extending to the surface;

a drill stem mounted within the forward and rearward bearings of the casing for rotation relative to the casing, the bearings preventing movement of the drill stem relative the casing along the elongate axis, a portion of the drill stem extending outward from the casing at the forward end thereof;

a drill bit mounted on said portion of said drill stem for rotary motion about a drill bit axis, the drill bit having a cutting circle;

a deflection shoe mounted on a first side of the casing, at least a portion of the deflection shoe extending outside the cutting circle of the drill bit.

19. The apparatus of claim 18 wherein the drill bit axis is parallel the elongate axis of the body.

20. The apparatus of claim 18 wherein the drill bit is a three cone rotary bit.

21. An apparatus for boring a hole with directional control, comprising:

a casing having an elongate axis and a forward end, the casing mounting a forward bearing therein and a rearward bearing therein;

a drill stem mounted within the forward and rearward bearings of the casing for rotation relative to the casing, a portion of the drill stem extending outward from the casing at the forward end thereof;

a drill bit mounted on said portion of said drill stem for rotary motion about a drill bit axis, the drill bit having a cutting circle;

a deflection shoe mounted on a first side of the casing, at least a portion of the deflection shoe extending outside the cutting circle of the drill bit;

the drill bit axis being offset from the elongate axis.

22. An apparatus for boring a hole with directional control, comprising:

a casing having an elongate axis and a forward end the casing mounting a forward bearing therein and a rearward bearing therein;

a drill stem mounted within the forward and rearward bearings of the casing for rotation relative to the casing, a portion of the drill stem extending outward from the casing at the forward end thereof;

a drill bit mounted on said portion of said drill stem for rotary motion about a drill bit axis, the drill bit having a cutting circle;

a deflection shoe mounted on a first side of the casing, at least a portion of the deflection shoe extending outside the cutting circle of the drill bit;

the drill bit axis being at an angle relative to the elongate axis of the body.

23. An apparatus for boring a hole with directional control, comprising:

a casing having an elongate axis and a forward end, the casing mounting a forward bearing therein and a rearward bearing therein;

a drill stem mounted within the forward and rearward bearings of the casing for rotation relative to the casing, a portion of the drill stem extending outward from the casing at the forward end thereof;

a drill bit mounted on said portion of said drill stem for rotary motion about a drill bit axis, the drill bit having a cutting circle;

a deflection shoe mounted on a first side of the casing, at least a portion of the deflection shoe extending outside the cutting circle of the drill bit;

the drill stem being flexible.

24. The apparatus of claim 23 wherein the drill stem is mounted within the body at an angle relative to the elongate axis of the body.

25. An apparatus for boring a hole with directional control, comprising:

a casing having an elongate axis and a forward end, the casing mounting a forward bearing therein and a rearward bearing therein;

a drill stem mounted within the forward and rearward bearings of the casing for rotation relative to the casing, a portion of the drill stem extending outward from the casing at the forward end thereof;

a drill bit mounted on said portion of said drill stem for rotary motion about a drill bit axis, the drill bit having a cutting circle;

a deflection shoe mounted on a first side of the casing, at least a portion of the deflection shoe extending outside the cutting circle of the drill bit;

a signal beacon being mounted in the body.

26. The apparatus of claim 25 wherein the signal beacon is mounted on the first side of the body to assist the deflection shoe with at least a portion of the signal beacon extending outside the cutting circle of the drilling bit.

27. The apparatus of claim 25 wherein the signal beacon is mounted on the side of the body opposite the first side.

28. An apparatus for boring a hole with directional control, comprising:

a casing having an elongate axis and a forward end, the casing mounting a forward bearing therein and a rearward bearing therein;

a drill stem mounted within the forward and rearward bearings of the casing for rotation relative to the casing, a portion of the drill stem extending outward from the casing at the forward end thereof;

a drill bit mounted on said portion of said drill stem for rotary motion about a drill bit axis, the drill bit having a cutting circle;

a deflection shoe mounted on a first side of the casing, at least a portion of the deflection shoe extending outside the cutting circle of the drill bit;

a direction change mechanism, said direction change mechanism including a first dog fixed in the casing and an element for rotating the drill stem but moving along the centerline axis of the housing relative to the drill stem, a rotating dog mounted on said element, the element being movable along the centerline axis of the housing from a first position with the dogs disengaged to a second position engaging the dogs to rotate the casing.

29. An apparatus for boring a hole with directional control, comprising:

a casing having an elongate axis and a forward end, the casing mounting a forward beating therein and a rearward beating therein;

a drill stem mounted within the forward and rearward beatings of the casing for rotation relative to the casing, a portion of the drill stem extending outward from the casing at the forward end thereof;

a drill bit mounted on said portion of said drill stem for rotary motion about a drill bit axis, the drill bit having a cutting circle;

a deflection shoe mounted on a first side of the casing, at least a portion of the deflection shoe extending outside the cutting circle of the drill bit;

the deflection shoe being bolted to the casing.

30. A method for boring a hole with directional control from the surface, comprising the steps of:

simultaneously rotating a casing extending into the hole from the surface and a drill stem extending into the hole from the surface while thrusting the casing and drill stem forward in the hole, the casing having a forward end and the drill stem being mounted to the casing for rotation relative thereto at the forward end, a drill bit being mounted on the drill stem at the forward end;

stopping the rotation of the casing while continuing rotation of the drill stem to form a curved hole, the casing having a deflection shoe thereon at the forward end to deflect the hole.

31. The method of claim 30 further comprising the step of mounting the drill stem within the casing so that the axis of rotation of the drill bit is constantly noncoincident with the axis of rotation of the casing at the forward end.

* * * * *